United States Patent [19]

Guntermann et al.

[11] 4,384,751

[45] May 24, 1983

[54] SHELVING UNITS AND THEIR USE IN DISPLAY CABINETS AND REARRANGEABLE SHOP FITTINGS

[75] Inventors: Rita Guntermann; Hermann Siekmann, both of Selb, Fed. Rep. of Germany

[73] Assignee: Rosenthal Technik AG, Selb, Fed. Rep. of Germany

[21] Appl. No.: 200,904

[22] Filed: Oct. 27, 1980

[30] Foreign Application Priority Data

Nov. 12, 1979 [DE] Fed. Rep. of Germany ..... 2945644

[51] Int. Cl.[3] ..... A47B 47/00; A47B 43/00

[52] U.S. Cl. ..... 312/257 SK; 312/107; 312/111; 312/223; 108/111

[58] Field of Search ..... 312/257 SK, 257 SM, 312/223, 107, 111, 224, 282, 283; 108/111

[56] References Cited

U.S. PATENT DOCUMENTS

| | | | |
|---|---|---|---|
| Re. 28,244 | 11/1974 | Evans | 108/111 |
| 193,339 | 7/1877 | Lothrop | 312/107 |
| 775,766 | 11/1904 | Abercrombie | 108/111 |
| 1,416,566 | 5/1922 | McCleary | 312/223 |
| 1,756,883 | 4/1930 | Russell | 312/223 |
| 1,874,245 | 8/1932 | Corrigan | 312/223 |
| 2,291,265 | 7/1942 | Viglietta | 108/111 |
| 2,344,800 | 3/1944 | Butcher | 312/223 |
| 2,565,079 | 8/1951 | Kern | 312/223 |
| 3,038,771 | 6/1962 | Schwartz et al. | 312/223 |
| 3,043,642 | 7/1962 | Nelson et al. | 312/111 |
| 3,401,993 | 9/1968 | Fenkel | 312/111 |
| 3,491,896 | 1/1970 | Crary | 108/111 |
| 3,575,465 | 4/1971 | Dolby | 312/107 |
| 3,734,033 | 5/1973 | Downing | 108/111 |
| 3,908,562 | 9/1975 | Wittschen | 108/111 |
| 3,920,299 | 11/1975 | Propst et al. | 312/223 |
| 3,948,581 | 4/1976 | Helman et al. | 312/107 |
| 3,995,925 | 12/1976 | Roesler | 312/283 |
| 4,056,295 | 11/1977 | Downing | 312/111 |
| 4,117,783 | 10/1978 | Eckel et al. | 108/111 |
| 4,191,436 | 3/1980 | Cherry | 312/257 SK |

FOREIGN PATENT DOCUMENTS

| | | | |
|---|---|---|---|
| 172354 | 1/1905 | Fed. Rep. of Germany . | |
| 7344728 | 3/1974 | Fed. Rep. of Germany . | |
| 1753832 | 8/1974 | Fed. Rep. of Germany | 312/107 |
| 2309573 | 9/1974 | Fed. Rep. of Germany . | |
| 2451101 | 10/1974 | Fed. Rep. of Germany . | |
| 2525619 | 6/1975 | Fed. Rep. of Germany . | |
| 2808855 | 9/1979 | Fed. Rep. of Germany . | |
| 1465101 | 1/1965 | France | 312/111 |
| 2368244 | 6/1978 | France | 312/107 |
| 542249 | 1/1942 | United Kingdom . | |
| 645001 | 10/1950 | United Kingdom . | |
| 757372 | 9/1956 | United Kingdom . | |
| 937892 | 9/1963 | United Kingdom . | |
| 1137871 | 12/1968 | United Kingdom . | |
| 1398744 | 6/1973 | United Kingdom . | |
| 1354284 | 5/1974 | United Kingdom | 312/111 |
| 1364208 | 8/1974 | United Kingdom . | |
| 1434359 | 5/1976 | United Kingdom . | |

*Primary Examiner*—Victor N. Sakran

*Attorney, Agent, or Firm*—Schwartz, Jeffery, Schwaab, Mack, Blumenthal & Koch

[57] ABSTRACT

A shelving unit comprises a pair of ladder-like members each formed from two vertical elements connected by a plurality of horizontal elements. Several interchangeable generally rectangular shelves rest upon respective opposed pairs of the horizontal elements. Each of the shelves presents a recessed area along three of its edges which receives an adjacent edge of a U-shaped wall element. At least one, and preferably the front two, of the vertical elements provides a lighting tube for allowing illumination of displayed goods. The shelves can be rearranged without altering the electrical installation for the lighting tube. A series of the shelving units can be formed as a display cabinet, which can itself be formed as an enclosure to which access is gained through a covered entrance way constituting an information region.

21 Claims, 7 Drawing Figures

SHELVING UNITS AND THEIR USE IN DISPLAY CABINETS AND REARRANGEABLE SHOP FITTINGS

FIELD OF THE INVENTION

The present invention relates to shelving units and to their use in forming display cabinets as well as rearrangeable shop fittings.

DESCRIPTION OF THE PRIOR ART

Numerous fit-together shelving units are known. Many of the known shelving units are unsuitable, however, for use as fittings in shops because their assembly is too complicated making rearrangement of their shelves too difficult.

Shelving units are also known for displaying valuable goods. Such units are frequently mounted on small wheels so that they are easily movable and then can be used either for wall or for central display. Such a display shelving unit with shelf compartments arranged one above the other is known for example from German Patent Specification No. 2,525,619. This shelving unit consists of a left and a right side frame, each consisting of a forward and a rear square beam and connected with a transverse frame at top and bottom. Furthermore in German Published Specification No. 28 08 855 a fit-together shelving unit is described. While with such shelving units it is possible to show many goods, they are not well suited to a self-contained display of porcelain, ceramics, glass, cutlery, gifts and objets d'art. One problem is that these kinds of valuable goods benefit from close illumination, but the electrical installation necessary for such close illumination again makes rearrangement of the shelves too difficult.

Moreover, in selling articles such as porcelain, ceramics, glass, cutlery and the like it is desirable to effect a separation into an information zone and a sale zone. Also, the design of the shelving unit should be of such appearance that, by insertion of the shelf, such stability of the shelving unit is achieved that it can stand independently in the room.

SUMMARY

It is therefore an object of the present invention to produce a variable display and shop fitting, accommodating separation of information zone and sales zone, in which the displayed goods, such as crockery, glassware and cutlery receive optimum illumination.

It is a further object of the invention to provide such an apparatus in which the individual shelving elements are readily adaptable to various configurations and various sales areas and in which a rapid and uncomplicated assembly at the site may be achieved.

It is a further object of the invention to provide such an apparatus in which the individual shelving units are simple to transport, are capable of variable alignment with one another, and are capable of assembly without special manufacture, and in which there is also the possibility of concealed storage for goods.

The objects of the invention are achieved and the drawbacks of the prior art are overcome by the shelving unit, display cabinet and rearrangeable shop fitting of the present invention. According to the present invention, a shelving unit for displaying goods includes a pair of ladder-like members each formed from two vertical elements connected by a plurality of horizontal elements. The pair of ladder-like elements are so disposed relative to each other as to provide horizontally spaced, opposed pairs of horizontal elements. The shelving unit further includes a plurality of shelves, each shelf resting upon one opposed pair of horizontal elements. The shelves include recessed areas. There are a plurality of wall elements, part of each wall element being received in the recessed area of a cooperating shelf, whereby the shelves and wall elements are coupled together. At least one of the vertical elements provides a lighting tube for illuminating the displayed goods.

Each of the shelves has an upper side, a lower side and periphery. The recessed area of each shelf extends partially around the shelf on the upper surface thereof. Each wall element has a lower edge. The lower edge of the wall element is received in the recessed area in the upper surface of an associated shelf. One or more shelves are sandwiched between two wall elements, namely, an upper wall element and a lower wall element. The lower wall element has an upper edge and the shelf has a recessed area in its lower side which corresponds in configuration with the recessed area of the upper side. The upper edge of the lower wall element is received in the recessed area in the lower side of the shelf to couple the lower wall element and the shelf together. Each shelf includes four sides and four corners. The recessed areas in the upper and lower sides are each in the form of a continuous recession extending adjacent to and along three of the four sides of the shelf to provide a "U" configuration. The wall elements also have a "U" shaped configuration, such configuration corresponding with that of the recessed areas. The upper side of at least certain of the shelves may include a removable covered lining. The four corners of each of the shelves cooperate with the vertical elements and are formed as indentations having outlines complimentary to those of the cooperating vertical elements.

Each of the vertical elements comprises one or more aligned hollow tubes. At least one and preferably two vertical elements include a light source disposed therewithin and an elongated vertical slot in the region of the light source through which slot light from the light source may pass to illuminate the displayed goods. Each ladder-like member includes a front vertical element and a rear vertical element, so that the pair of ladder-like members includes two front vertical elements partially defining a front side of the shelving unit and two rear vertical elements partially defining the rear side of the shelving unit. The two front vertical elements preferably provide both lighting tubes for illuminating the displayed goods.

All of the wall elements face in the same direction and open toward the front of the shelving unit. At least one of the shelves preferably includes a slidably mounted panel on which advertising literature, for example, may be placed. This slidably mounted panel may be movable toward the rear side of the shelving unit.

Not all of the wall elements need be identical. For example, they may be of different heights, and one or more of them may support an illuminated glass panel. A cover may be provided above the uppermost wall element, and the lowermost wall element may at least partly house an illuminated glass-fronted drawer assembly.

Each of the horizontal elements forming the ladder-like members has a horizontal width dimension. Each of the shelves extends across no more than half of the width of the horizontal elements which it rests on.

A series of shelving units according to the present invention may form a display cabinet wherein at least a pair of shelving units are arranged in side-by-side relationship to form a shelving wall. In the shelving wall one side of one shelving unit immediately adjoins one side of the other shelving unit. The adjoining sides of the pair of shelving units are defined by one shared ladder-like member which the pair of shelving units has in common. Thus, one of the ladder-like members of one shelving unit is also one of the ladder-like members of the other unit. Also, the horizontal elements of the one shared ladder-like member are also shared among the two adjoining shelving units. Thus, the adjoining shelving units include pairs of adjoining shelves, one shelf of an adjoining pair being disposed in one shelving unit of the pair of units, the other being disposed in the other shelving unit. Each adjoining pair of shelves lie in a common horizontal plane and rest upon the shared horizontal element of the one shared ladder-like member located therebetween. The shelving wall may include more than two adjoining shelving units connected together at preselected angles to one another.

In a particularly preferred embodiment of the present invention, a rearrangeable shop fitting is formed from a plurality of shelving units connected together at angles to form a non-linear display cabinet in which the walls define a central display region from which any goods displayed on the shelving units may be viewed. The shelving wall of the display cabinet has two free ends, these ends being connected by a covered entrance way which has a display surface illuminated from above. On this surface, information about the goods on display may be provided. The covered entrance way thus constitutes an information region through which a person such as a prospective customer must pass before gaining access to the display region. With this type of rearrangeable shop fitting, there is a clear separation between the information region and the display region.

Preferably, the covered entrance way has an ornamental roof surmounting rigid supports which are interconnected by ornamental walls formed of sheet material such as slats, or a woven or perforated sheet material. The illumination for the covered entrance way and in particular for the display surface thereof is provided by a lighting cone located centrally of a ceiling mirror, with further light sources in the form of lighting tubes being located around the periphery of the ceiling mirror.

A shelving unit according to the present invention, and its preferred use in both a display cabinet and a rearrangeable shop fitting, will now be described, by way of example only, with reference to the accompanying drawings.

DETAILED DESCRIPTION

Figure 1:
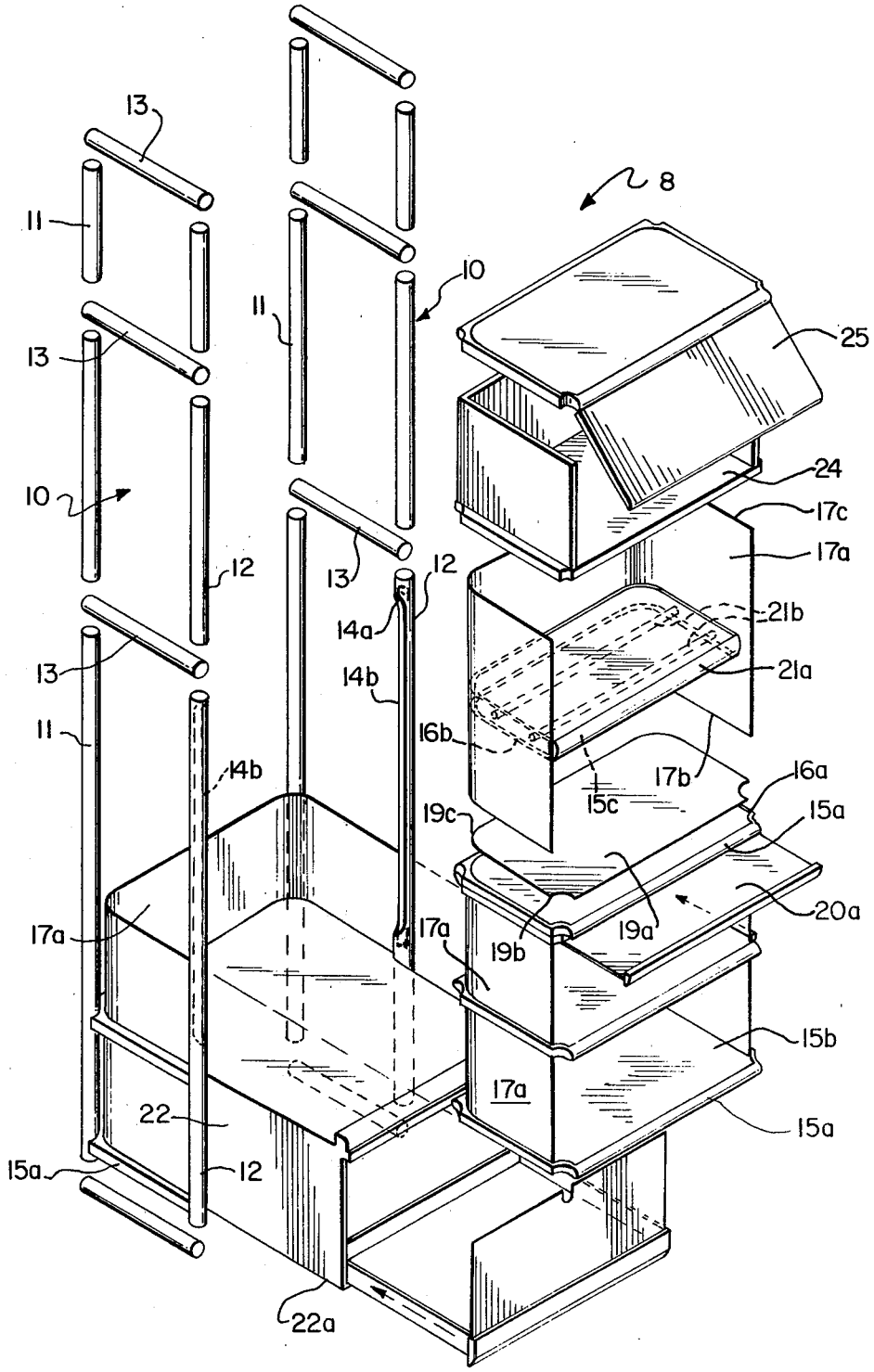
FIG. 1 is an exploded perspective view of a typical shelving unit in accordance with the present invention.

The typical shelving unit 8 shown in FIG. 1 includes a pair of ladder-like members 10 each formed from two vertical elements 11, 12 connected by a plurality of horizontal elements 13.

The rear vertical elements 11 are formed as hollow pipes of, for example, chromed metal. The front vertical elements 12 are also formed as hollow pipes, and are identical to the rear vertical elements 11 apart from the provision of respective vertical slots 14*a*. Mounted within the front vertical elements 12, and in alignment with the vertical slots 14*a*, are a respective pair of light sources 14*b* in the form of lighting tubes which are preferably conventional elongate neon lights. The horizontal elements 13, which are again formed as hollow pipes of, for example, chromed metal, are connected to the vertical elements 11, 12 by any suitable means. Although shown as being of circular section, the horizontal elements 13 in particular could equally well be of square section.

A plurality of generally square (not shown) or rectangular (as shown) shelves 15 rest upon respective opposed pairs of the horizontal elements 13.

At least one of the shelves 15*a* presents a recessed area 16*a* by three of its edges. The recessed area 16*a* receives an adjacent edge of a U-shaped wall element 17*a*. Preferably, the upper surface 15*b* of each of the shelves 15*a* presents a recess 16*a* which receives a lower edge 17*b* of a respective wall element 17*a*, those shelves 15*a* sandwiched between two of the wall elements 17*a* also being formed with a similar recessed area 16*b* in their lower surfaces 15*c*. That is, the upper edges 17*c* of certain wall elements will engage with an adjacent lower recessed area 16*b*. Some or all of the recessed areas 16*a*, 16*b* could be replaced by grooves if desired.

All of the wall elements 17*a* are shown facing in the same direction and opening towards the front of the unit.

The four corners of each of the shelves 15*a* are formed with concave cut-outs in the form of indentations 18 having outlines complementary to those of the vertical elements 11, 12 adjacent thereto. Moreover, each of the shelves 15*a* extends across no more than half of the width of the horizontal elements 13 adjacent thereto. This enables an adjacent shelving unit to share just a single ladder-like member 10 located therebetween as described in more detail hereinafter.

At least one, and preferably all, of the shelves 15*a* support on their upper surfaces respective removable covered linings 19*a*. The linings 19*a* may present on a backing an aesthetically pleasing material such as velvet, leather, silk or their synthetic equivalents. Moreover, if the lower edges 17*b* of the wall elements 17*a* are formed with inwardly facing lips, which lie in the recessed areas 16*a*, the linings 19*a* can extend over said lips effectively to clamp the wall elements 17*a* in position in the recessed areas 16*a*. If necessary, the linings 19*a* can be temporarily secured to the upper surfaces 15*b* of shelves 15*a*, to assist said clamping effect. The front corners 19*b* of the linings 19*a* are recessed, having outlines complementary to those of the adjacent front vertical elements 12, whereas the rear corners 19*c* of the linings 19*a* are curved to be complementary to the curved corners of the channel shape for the wall elements 17*a*. This again leads to a clamping effect of the wall elements 17*a* between the rear vertical elements 11 and the linings 19*a*.

At least one, and preferably two, of the shelves 15*a* include respective slidably mounted panels 20*a*, 20*b* with one of the panels 20*a* then being mounted for movement towards the front of the unit, and the other panel 20*b* (see FIG. 3) being mounted for movement towards the rear of the unit.

The wall elements may be formed of any suitable material i.e. preferably both strong and decorative. Wood, metal and translucent plastics are favored. However, the wall elements 17*a* can themselves be provided with removable coverings (not shown) similar to the above-mentioned removable linings 19*a*.

The wall elements 17*a* need not necessarily be identical to one another and may for example be of different height. One of the wall elements 17*a* is shown supporting an illuminated glass panel 21*a* having therein light sources 21*b* which are preferably in the form of elongate neon lighting tubes. Panel 21*a* is especially suitable for the display of glass goods. Wall elements 17*a* therebelow are suitable for the display of porcelain and ceramic goods. The two wall element 17*a* at least partially houses an illuminated glass-fronted drawer assembly 22*a* supported by a central foot 23 (see FIG. 2B). The drawer assembly 22*a* may display for example racks of cutlery 22*b*. A closed store for replacement goods is provided by a cupboard 24 mounted above the uppermost wall element 17, the cupboard 24 including a hinged front flap 25 for ease of access.

Naturally, the particular arrangement of the shelves 15*a* and the wall elements 17*a* shown in FIG. 1 is given only as a guide because in practice different arrangements or groupings are equally possible.

Although the shelving unit is self-supporting, rigidity is improved by the provision of further horizontal elements 13 spanning the ladder-like members 10 at both top and bottom.

The assembly of the shelving unit 8 commences with the lowermost shelf panel 15*a* being laid on to the lower transverse horizontal elements 13. Then the U-shaped wall element 17*a* is inserted into the recessed area 16*a* of the shelf 15*a* and clamped by means of the lining 19*a*. The shelves 15*a* and the linings 19*a*, as mentioned, have indentations for the tubes 11, 12. The upper edge 17*c* of the wall element 17*a* is likewise inserted into a recessed area 16*b* of the following shelf 15*a*. The upper cupboard 24, provided with a flap 25, forms the upper conclusion of the assembled shelving unit 8. Beneath the upper cupboard 25 there is situated the glass shelf 21*a* which has a horizontal illuminating device 21*b*. Then the lined shelves for the porcelain and ceramics presentation are situated in the middle zone of the shelving unit 8. Both presentation zones are separated by a special double shelf with pull-out panel 20*a*. Into the lowermost part of the shelving unit 8 lower drawer assembly 22*a* is pushed. This drawer assembly can serve either as a store for goods or, with a transparent covering, as a goods carrier provided with a cutlery compartment 22*b*. Further variations in a shelving unit 8 are possible, as mentioned, in that for example, on the rear 9 of the shelving unit 8, an outwardly drawn shelf 20*b* is situated which is intended to carry sales documents or informative material.

Figure 2A:
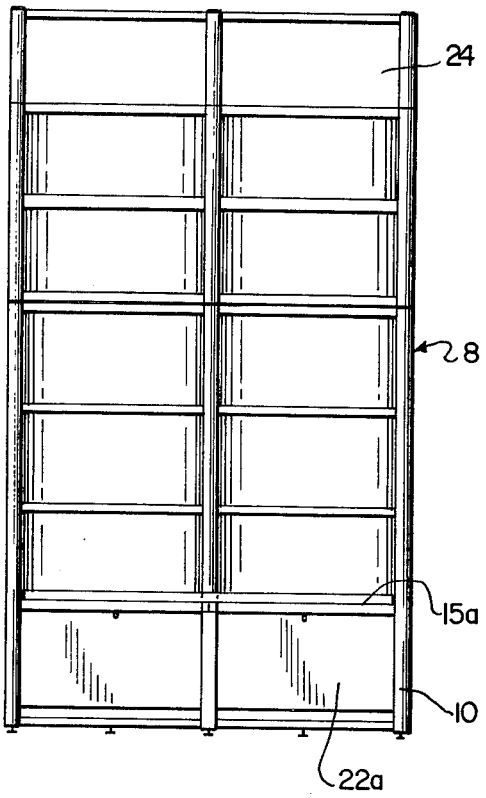
FIGS. 2A, 2B and 2C are respectively front, side and plan views of the shelving units arranged to form a display cabinet.
Figure 2B:
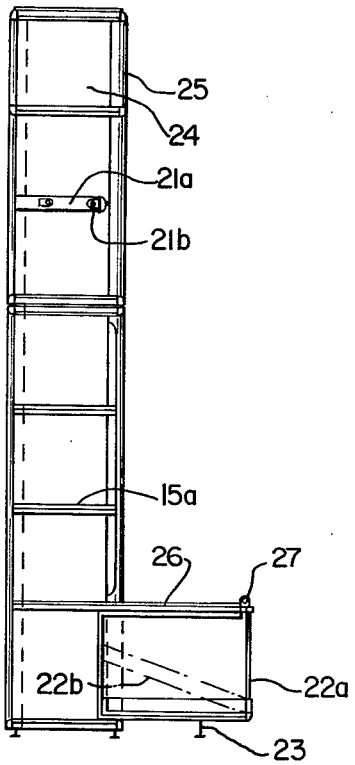
Figure 2C:
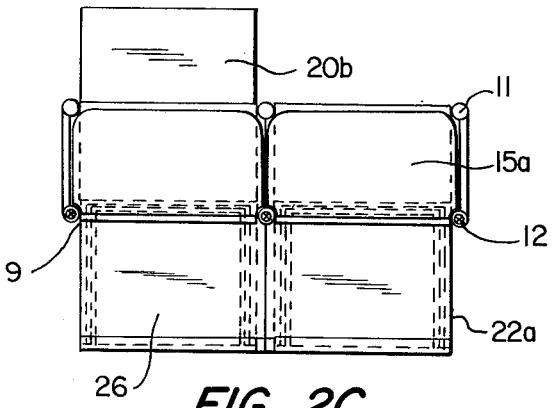
Figure 5:
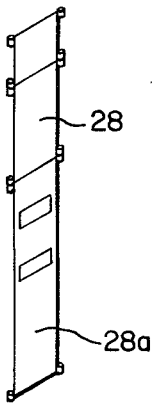
FIG. 5 is a detailed, perspective view of a connector used in the shop fitting of FIG. 3.

The above-described shelving unit is to be regarded as a basic element. A variant is the provision of a double element, as shown in FIGS. 2A, 2B and 2C, which for convenience will be referred to as a display cabinet. It will be seen that the display cabinet requires only a total of three of the ladder-like members 10. This is because each adjacent pair of the shelves 15*a* lying in a common horizontal plane rest upon the shared horizontal element 13 of the single ladder-like member 10 located therebetween. The two drawer assemblies 22*a* are covered by a particularly large shelf 26 with an appropriate removable lining to provide a table-like presentation area whose front edge carries a lighting tube 27. It will be appreciated that a series of the basic shelving units may be arranged side-by-side as a wall to form a much larger display cabinet. A non-linear display cabinet is formed by connecting together a plurality of said walls at preselected angles to one another by the use of connecting pieces 28*a* (see FIGS. 3 and 5). The connecting pieces 28*a* may be of the same material as the wall elements 17*a*, may snap or screw fasten or otherwise be secured to the front vertical elements 12, and may include mountings 28*b* for advertising leaflet holders.

Figure 3:
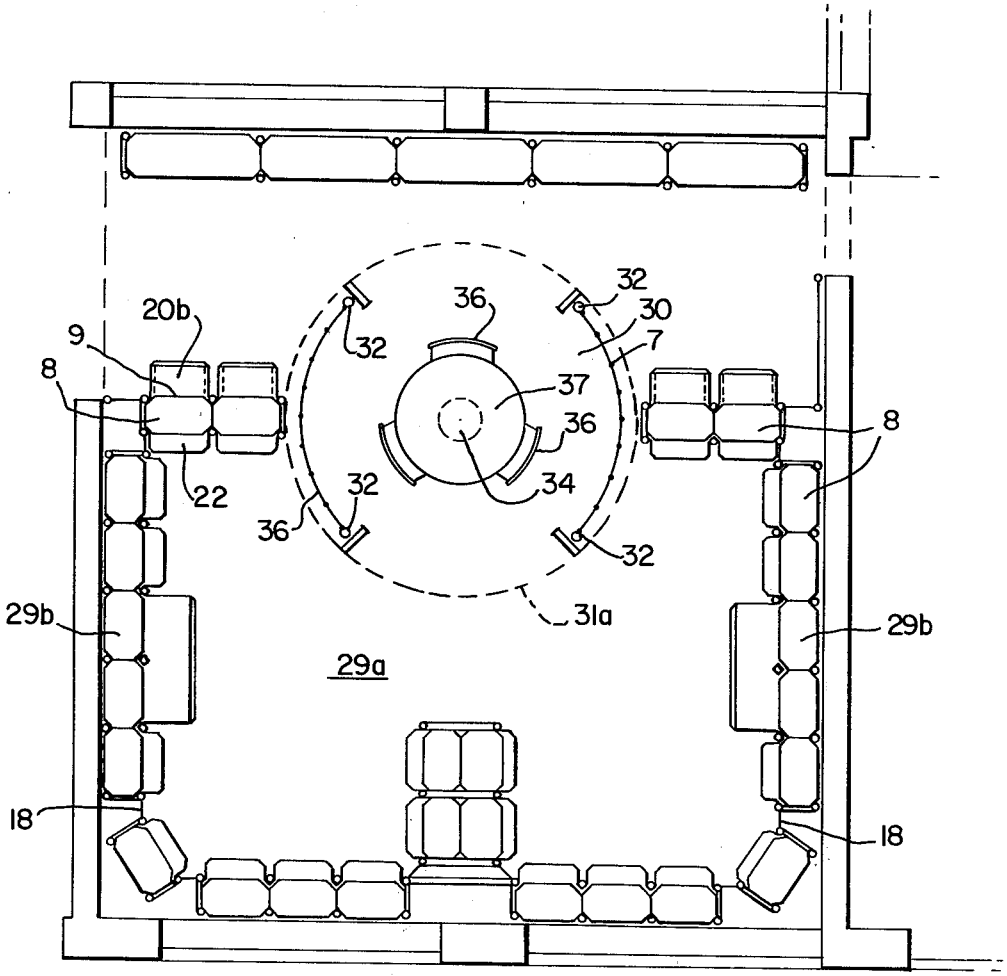
FIG. 3 is a plan view of twenty-seven of the shelving units forming a non-linear display cabinet arranged in association with a covered entrance way to form a rearrangeable shop fitting.
Figure 4:
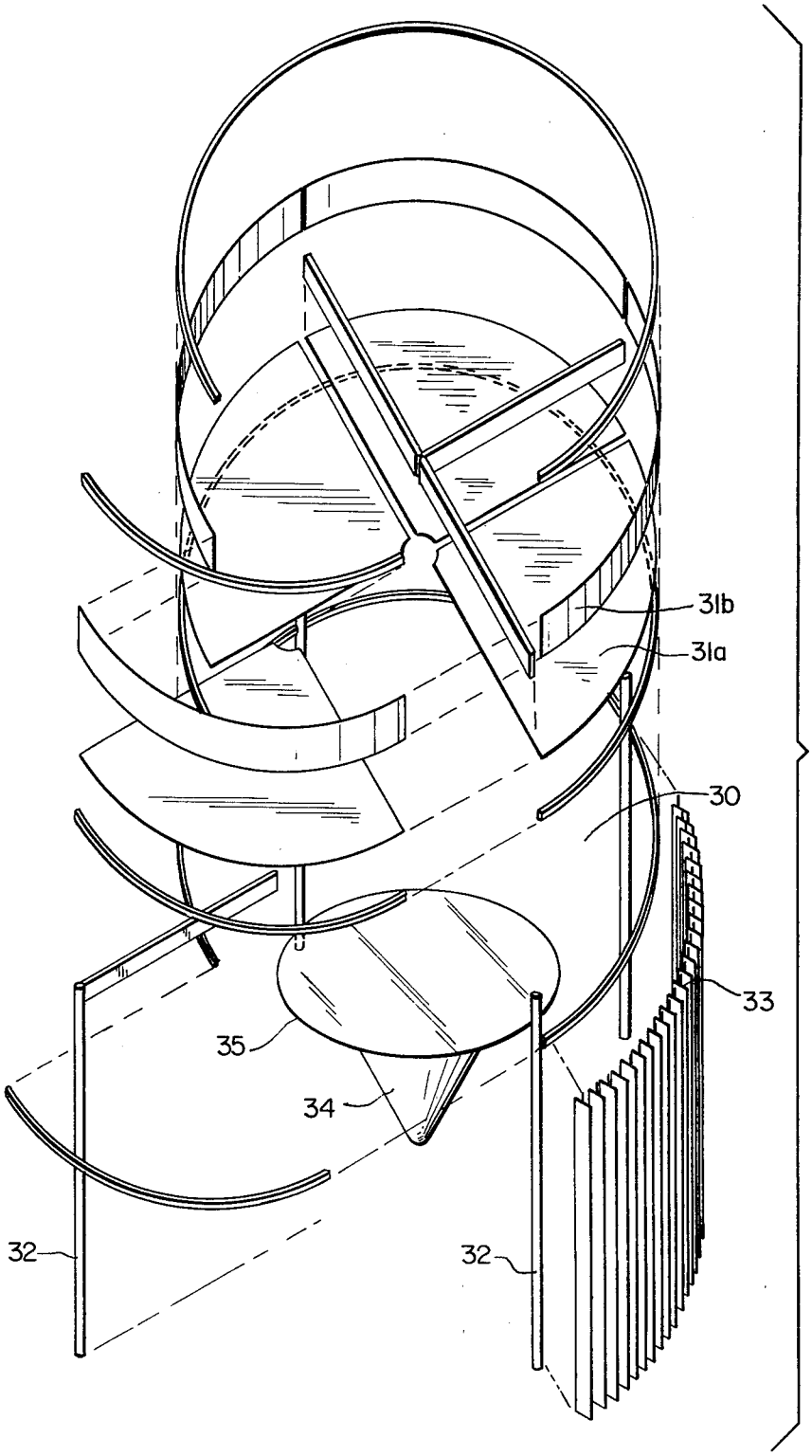
FIG. 4 is an exploded, perspective view of part of an entrance way 30 used in the shop fitting of FIG. 3.

A particularly preferred embodiment of the present invention is shown in FIG. 3. Here, the walls of a non-linear display cabinet of the kind described hereinabove define a central display region 29*a* from which any goods displayed on the shelving units can be viewed. The non-linear display cabinet fits into a sales area defined by shop walls 29*b*. The two free ends of the walls are connected by a covered entrance way 30 which has no doors but has a surface illuminated from above on which information about the goods on display can be provided. The covered entrance way 30 thus constitutes an information region through which a customer must pass before gaining access to the display region.

The covered entrance way 30 is of circular construction and has an ornamental roof 31*a* surmounting four rigid supports 32 which are interconnected by ornamental walls 33. The roof 31*a* may be ornamental only to the extent that it includes for example a peripheral upstanding rim 31*b*. The walls 33 are generally more ornamental, however, and indeed are preferably formed of flexible or at least non-rigid sheet material. Suitable materials for the walls 33 are woven or perforated sheet metal, or possibly slats of sheet metal hung as a vertical venetian blind, as these give a pleasing "non-separating" effect, i.e., they are not totally opaque. The illumination in the covered entrance way 30 is provided by a lighting cone 34 located centrally of a ceiling mirror 35 with further lighting tubes 36 being located around the periphery of the ceiling mirror 35. The lighting cone 34 may provide illumination primarily for a laid table 37 with surrounding chairs, and the lighting tubes 36 may provide illumination primarily for advertising information carried by holders fixed to the rigid supports 32.

The above-described arrangement of FIG. 3 can be regarded as a total rearrangeable shop fitting.

Shelving units according to the present invention have the advantage of easy assembly. Likewise simple transport to the assembly site is possible. Despite individual configuration, the production of the individual parts is cost-saving, since hitherto in shopfitting only special manufactures were often possible due to corners, pillars and other obstructions in the floor plan. The present shelving units process over the known shelving units the outstanding advantage that close illumination is provided by the presence of at least one lighting tube is association with a vertical element. The individual parts of the shelving units are also of such design that no confusion can occur.

Display cabinets formed from the shelving units can be made larger or smaller according to need and available space, but for reasons of sales economy a minimum area of 30 square meters should be available. When not in use the entire display cabinet can be dismantled into each individual part and stored in a space-saving manner.

The separation between the display region and the information region in the rearrangeable shop fitting offers a goods sales aid to the trader and a purchasing aid to the customer.

What is claimed is:

1. A shelving unit for displaying goods, the unit comprising:

a pair of ladder-like members each formed from two vertical elements connected by a plurality of horizontal elements, the pair of ladder-like elements being so disposed relative to each other as to provide horizontally spaced, opposed pairs of horizontal elements;

a plurality of shelves, wherein one shelf rests upon one opposed pair of horizontal elements, and each shelf includes a recessed area and further wherein each of the shelves has an upper side, a lower side, and a periphery; wherein the recessed area of each shelf extends partially around each shelf on the upper side thereof;

a plurality of wall elements, each wall element having a lower edge, the lower edge of each wall element being received in the recessed area in the upper side of an associated shelf, wherein at least one shelf is sandwiched between two wall elements, namely, an upper wall element and a lower wall element, the lower wall element having an upper edge, said at least one shelf having a recessed area in said lower side thereof which recess corresponds in configuration with the recessed area of the upper side, the upper edge of said lower wall element being received in the recessed area in the lower side of said at least one shelf to couple the lower wall element and said at least one shelf together, wherein said at least one shelf includes four sides and four corners and wherein the recessed areas in the upper and lower sides thereof are each in the form of a continuous recession extending adjacent to and along three of said sides to provide a "U" configuration, and wherein the wall elements have a U-shaped configuration corresponding with that of the recessed areas; and at least one of the vertical elements providing a lighting tube for illuminating the displayed goods.

2. A shelving unit according to claim 1, including a removable covered lining on the upper side of at least one of the shelves.

3. A shelving unit according to claim 1, wherein the four corners of each of the shelves cooperate with the vertical elements and are formed as indentations having outlines complementary to those of the cooperating vertical elements.

4. A shelving unit for displaying goods, the unit comprising:

a pair of ladder-like members each formed from two vertical elements connected by a plurality of horizontal elements, the pair of ladder-like elements being so disposed relative to each other as to provide horizontally spaced, opposed pairs of horizontal elements;

a plurality of shelves, at least one of said shelves resting upon one opposed pair of horizontal elements, each of the shelves including a recessed area;

a plurality of wall elements, part of at least one wall element being received in the recessed area of said at least one shelf and another shelf being stacked on said at least one wall element and receiving another wall element, whereby the shelves and wall elements are coupled together; and at least one of the vertical elements providing a lighting tube for illuminating the displayed goods, wherein each of the vertical elements comprises a hollow tube, said at least one vertical element including a light source disposed therewithin and an elongated vertical slot in the region of said light source through which slot light from said light source may pass to illuminate the displayed goods.

5. A shelving unit according to claim 4 wherein each ladder-like member includes a front vertical element and a rear vertical element, so that the pair of ladder-like members includes two front vertical elements partially defining a front side of the shelving unit and two rear vertical elements partially defining the rear side of the shelving unit.

6. A shelving unit according to claim 5 wherein said two front vertical elements both provide lighting tubes for illuminating the displayed goods.

7. A shelving unit according to claim 5 wherein all of the wall elements face in the same direction and open towards the front of the shelving unit.

8. A shelving unit according to claim 5, wherein at least one of the shelves includes a slidably mounted panel.

9. A shelving unit according to claim 8, wherein the slidably mounted panel is movable towards the rear side of the shelving unit.

10. A shelving unit according to claim 4 wherein each of the horizontal elements has a horizontal width dimension and wherein each of the shelves extends across no more than half of the width of the horizontal elements which it rests on.

11. A shelving unit according to claim 4 including an illuminated glass panel on at least one of the wall elements.

12. A shelving unit according to claim 4 wherein the wall elements include an uppermost wall element and a lowermost wall element.

13. A shelving unit according to claim 12 wherein a cupboard is provided above the uppermost wall element.

14. A shelving unit according to claim 12 wherein the lowermost wall element at least partially houses an illuminated glass-fronted drawer assembly.

15. A display cabinet including a pair of shelving units according to claim 4, said shelving units being arranged in side-by-side relationship to form a shelving wall wherein one side of one shelving unit immediately adjoins one side of the other shelving unit, the adjoining sides of the pair of shelving units being defined by one shared ladder-like member which the pair of shelving units has in common so that one of the ladder-like members of one shelving unit is also one of the ladder-like members of the other unit, so that the horizontal elements of the one shared ladder-like members are also shared among the two adjoining shelving units, and so that the adjoining shelving units include pairs of adjoining shelves, one shelf of an adjoining pair being disposed in one shelving unit of the pair of units, the other being disposed in the other shelving unit.

16. A display cabinet formed from a series of shelving units according to claim 15 wherein each adjoining pair of shelves lie in a common horizontal plane and rest upon the shared horizontal element of the one shared ladder-like member located therebetween.

17. A display cabinet according to claim 15 wherein the shelving wall includes more than two adjoining shelving units connected together at preselected angles to one another.

18. A rearrangeable shop fitting formed from a display cabinet according to claim 17, in which the shelving wall encloses an area defining a central display region from which any goods displayed on the shelving units can be viewed, the shelving wall having two free ends, the two free ends being connected by a covered entrance way which has a display surface illuminated from above, the covered entrance way thus constituting a region through which a person must pass before gaining access to the display region.

19. A rearrangeable shop fitting according to claim 18, wherein the covered entrance way has an ornamental roof surmounting rigid supports which are interconnected by ornamental walls formed of sheet material.

20. A rearrangeable shop fitting according to claim 19, wherein the covered entrance way includes a ceiling mirror adjacent its roof and wherein the illumination on the display surface is provided by a lighting cone located centrally of the ceiling mirror with further light sources being located around the periphery of the ceiling mirror.

21. A rearrangeable shop fitting according to claim 19 or claim 20, in which the ornamental walls are formed of a woven or perforated sheet metal.

* * * * *